United States Patent [19]

Viani

[11] Patent Number: 4,886,017

[45] Date of Patent: Dec. 12, 1989

[54] BOILERS WITH CATALYTIC COMBUSTION OF METHANE FOR HEATING WATER FOR DOMESTIC USE

[76] Inventor: Umberto Viani, Via Duilio, 8, Milano, Italy

[21] Appl. No.: 75,723

[22] Filed: Jul. 20, 1987

[30] Foreign Application Priority Data

Aug. 7, 1986 [IT] Italy ..... 21438 A/86

[51] Int. Cl.[4] ..... F22B 1/00

[52] U.S. Cl. ..... 122/4 D; 431/7; 110/345

[58] Field of Search ..... 122/4 D; 110/245, 263, 110/250, 342, 343, 185, 186; 431/7, 170

[56] References Cited

U.S. PATENT DOCUMENTS

| | | | |
|---|---|---|---|
| 2,997,286 | 8/1961 | Friese | 122/4 D |
| 3,110,300 | 11/1963 | Brown et al. | 122/4 D |
| 3,908,602 | 9/1975 | Brulfert et al. | 122/4 D |
| 3,912,002 | 10/1975 | Elliott | 122/4 D X |
| 3,966,391 | 6/1976 | Hindin et al. | 431/7 |
| 3,994,244 | 11/1976 | Pledger et al. | 110/345 X |

*Primary Examiner*—Henry C. Yuen

*Attorney, Agent, or Firm*—Arnold, White & Durkee

[57] ABSTRACT

A boiler with catalytic combustion of methane is described for heating water for domestic use, such as room heating or for sanitary use. The boiler comprises a container for the combustion catalyst which is based on metals of the platinum group, means for heat transfer between the gaseous combustion products and the water to be heated, a combustion control system for the methane, and a flue gas discharge system.

14 Claims, 4 Drawing Sheets

BOILERS WITH CATALYTIC COMBUSTION OF METHANE FOR HEATING WATER FOR DOMESTIC USE

BACKGROUND AND SUMMARY OF THE INVENTION

This invention relates to a boiler with catalytic combustion of methane for heating water for domestic use.

In particular, the boiler according to the present invention comprises a catalyst container, a catalyst, means for heat transfer between the gaseous combustion products and the water to be heated, a combustion triggering system for the methane, and a control system for said combustion.

The availability and economical convenience of methane have created in the case of domestic heating a demand for self-contained systems for the individual dwelling unit rather than centralised systems for hot water production, both for heating and sanitary purposes.

Efficient, easily maintained boilers have of necessity had to be constructed which are of small overall size because of the small dimensions of such dwelling units, particulary in town. Current commercially available boilers satisfy many of these requirements, but still suffer from many defects and are not completely satisfactory.

In particular, problems exist due to the fact that as the flame temperature resulting from methane combustion reaches 1300° C., the materials of construction of the heat exchanger for heating the water in the system become problematical. It is therefore necessary to reduce the temperature of the gaseous combustion products in order to obtain a temperature difference between these and the water which is not too high, so as to avoid the need for special materials.

Generally, this temperature reduction is established by increasing the distance between the burner and heat exchanger, and mixing the gaseous combustion products with air, thus reducing the thermal efficiency of the system.

A further problem results from the fact that the burner capacity must be set for peak heat delivery (for both seasonal and subjective reasons), with the result that the burner operation is intermittent.

This means that the burner undergoes frequent ignition and extinction, with a somewhat loud and disturbing ignition noise, especially if the boiler is located in a small inhabited room (such as in town apartments).

The most common ignition system for commercial burners, and which is also the most reliable, consists of a pilot flame which is always alight, with considerable gas consumption.

However, the pilot flame can easily be extinguished, thus preventing automatic restarting of the burner.

The aforesaid problems are solved with full satisfaction by the catalytic boiler according to the present invention.

In this respect, it has been found possible to obtain complete combustion of methane using a stoichiometric or slightly greater than stoichiometric quantity of oxygen either as such or in the form of air, by bringing the gas mixture into contact with a catalyst consisting of one or more metals of the platinum group, ie platinum, palladium, rhodium, ruthenium or iridium, supported on a solid material typically is divided form.

The metal quantity is typically between 0.01% and 10% of the total catalyst by weight.

The support material used can be alumina, silica, solid materials of ceramic type preferably with their surface covered with activated alumina, or the other solids commonly used for this type of catalyst. The alumina is preferably used in its gamma crystalline form of high surface area, typically from 800 to 1000 $m^2/g$.

Platinum and palladium are among the preferred metals, and in the preferred embodiments of the invention their concentration in the catalyst is between 0.1% and 0.5% by weight.

The supported catalysts according to the present invention normally consist of solids divided into particles which can be of the most varied shapes, such as spheres, cylinders, rings, granules or solids with honeycomb surfaces.

The particles typically have a size of between 0.1 and 30 mm in terms of their diameter if spherical or in terms of their major dimension if or irregular shape. This size ensures low pressure drop of the gas passing through the catalyst bed, thus preventing the need to use pumps or other devices to facilitate gas passage. A further possible form of the catalysts according to the present invention consists of ceramic plates with a honeycomb surface, covered with gamma-alumina which itself carries the metal or metals of the platinum group.

The preferred support for the present invention is alumina, preferably in the form of spheres of diameter between 0.1 mm and 30 mm.

The supported catalyst used in the boilers according to the present invention has a very long life because the methane distributed through town mains does not contain impurities which could poison it.

The supported catalysts according to the present invention are very active, allowing very high spatial velocity of the fed gas.

Typically, the spatial velocity with the catalysts according to the present invention lies between 5,000 and 100,000 volumes of gas per volume of catalyst per hour.

This high catalytic activity allows the catalyst to be used in various ways, while still obtaining total combustion of the fed methane.

In this respect, the catalyst can be arranged in a small layer with a thickness equal to or greater than 10 cm, equivalent to a catalyst volume of between 0.5 5 liters, and leaving empty the remaining space in the catalyst container, which has typically a volume of between 20 and 100 liters.

In this part of the container there is located a coiled tube, preferably of finned type, though which the water to be heated is passed.

Alternatively, the gaseous combustion products pass through a tube bundle, with the water to be heated passing through the shell side.

As these are common types of heat exchanger known to the expert of the art, it is not considered necessary to describe in further detail methods for heat transfer between the gaseous combustion products and the water.

A small electrical resistance heater is embedded in the catalyst layer to raise the catalyst temperature to the value necessary for triggering the reaction at the point of entry of the oxygen/methane mixture.

After the reaction has commenced, the catalyst bed temperature is kept above the triggering temperature by the heat evolved by the combustion reaction, and the electrical resistance heater is automatically disconnected, for reconnection each time the boiler is started.

With the catalysts according to the present invention, the triggering temperature of the methane/oxygen combustion reaction lies between 320° and 390° C. During normal boiler operation the catalyst bed temperature is typically between 400° and 700° C., due to the absence of flame in the catalyst reaction.

This temperature level allows the use of common construction materials both for the catalyst container and for the system for heat transfer with the water to be heated. Moreover, a reaction temperature of less than 700° C. prevents formation of the nitrogen oxides (from nitrogen and oxygen) which are always present when burning methane to give a flame at a temperature of 1300° C.

These nitrogen oxides constitute one of the damaging pollutants present in the atmosphere, and are among the factors responsible for acid rain. The fact that the methane combustion is flameless means that the disturbing noise due to burner ignition at each boiler restart is absent. In this embodiment, the catalyst layer disposed in the container forming the boiler shell thus in practice replaces the normal methane burner of commercially available boilers, with the double advantage of both keeping the combustion temperature constant to thus solve the construction materials problem, and of preventing burner ignition noise.

According to a further preferred embodiment of the present invention, a solid material in divided form is arranged above the said catalyst layer to completely fill the catalyst container.

In this case, the water coil is completely embedded in the bed of solid material, which acts as a temperature stabiliser and at the same time facilitates heat transfer between the gaseous combustion products and the water. If on the other hand a tube bundle is used for heat transfer, the solid material is advantageously disposed inside the tubes.

The divided solid material preferably used in these embodiments is the same, both in terms of type and in terms of particle size, as that used for supporting the catalyst, although it is possible to use other solid materials which do not interfere with the reaction and have the same particle size. It is also possible to distribute the catalytic material and the divided solid material as several alternate layers within the container, or alternatively the two can be mixed together.

In all cases the volumetric ratio of catalyst to divided solid material without metal is between 1:1 and 1:100. In a further embodiment of the invention, the entire container volume is filled with catalyst, the other characteristics of the embodiment regarding the filling of the container with an inert material being as in the preceding case.

This embodiment is preferably used for catalytic material of low noble metal content, to ensure complete methane combustion at low temperature. According to a further characteristic, the boilers according to the present invention comprise a reaction control system simply consisting of one or more thermocouples embedded in the catalyst bed to signal to a methane feed shut-off system when the temperature falls below the reaction triggering temperature.

This boiler control system also constitutes one of the advantages of the present invention, in that it obviates the defect due to soiling of the photoelectric cell system used for flame control in normal burners.

The methane feed shut-off system also controls the switching-on of the electrical resistance heater which heats that catalyst portion necessary for triggering the reaction at each boiler start.

It is possible, without this changing the essence of the invention, to use systems for recirculating the gaseous combustion products in order to preheat the feed gas and water, or to withdraw these gaseous combustion products by fans which improve or replace the normal stack draught.

According to a typical embodiment of the invention, the methane gas and oxygen are mixed together immediately prior to the gas entry into the catalyst container. It is however possible to feed the two gases into the container separately, using the first catalyst layer in correspondence with the triggering resistance heater as a mixer.

According to a typical embodiment of the present invention, the gaseous combustion products after preheating the feeds are in part fed into the reactor together with the feed air and methane. This gives a further control for maintaining the reaction temperature at the required level.

In all case, the air feed quantity is adjusted to obtain a ratio of oxygen to methane varying from stoichiometric to 20% volumetric excess over that necessary for total combustion.

DESCRIPTION OF SOME PREFERRED EMBODIMENTS

Descriptions are given hereinafter of some preferred embodiments of the boiler according to the present invention, with reference to the figures.

Figure 1:
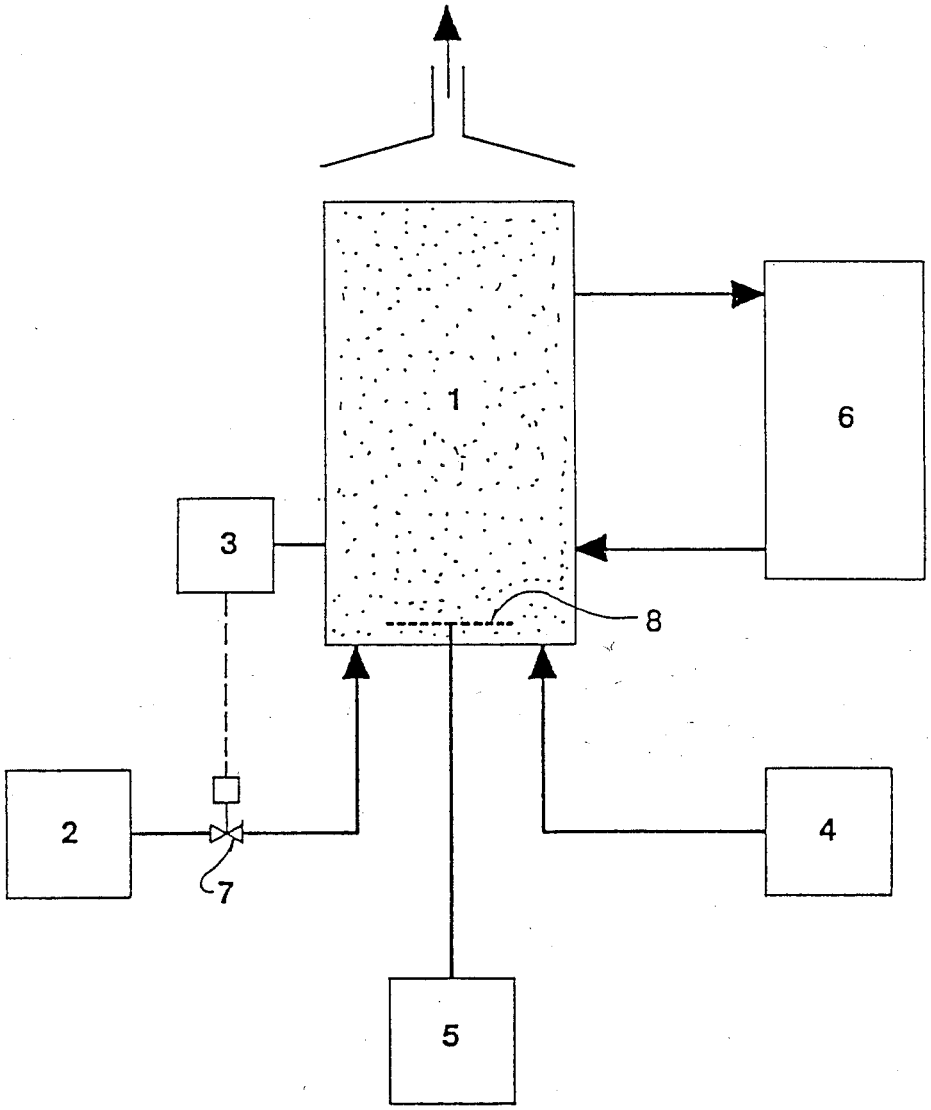
FIG. 1 is a block diagram of the boiler.

FIG. 1 shows a block diagram of a boiler according to the invention.

The methane gas 2 is fed through a valve 7 controlled by a combustion control device 3 into the container 1 which contains the catalyst.

The combustion triggering device consists of an electrical resistance heater 8 controlled by a device 5.

The combustion oxygen 4 is fed to the container 1 either separately from the methane (as shown in the figure) or after premixing.

The water circulates through a coil (not shown) within the container 1 and through the user system 6 (radiator system with circulation pump).

FIGS. 2 to 7 show some embodiments of boilers according to the invention in which the oxygen is fed through the pipe 11 and the methane through the pipe 12. The two gases are mixed and fed into the catalyst container 14 in correspondence with the combustion triggering system 13.

Figure 2:
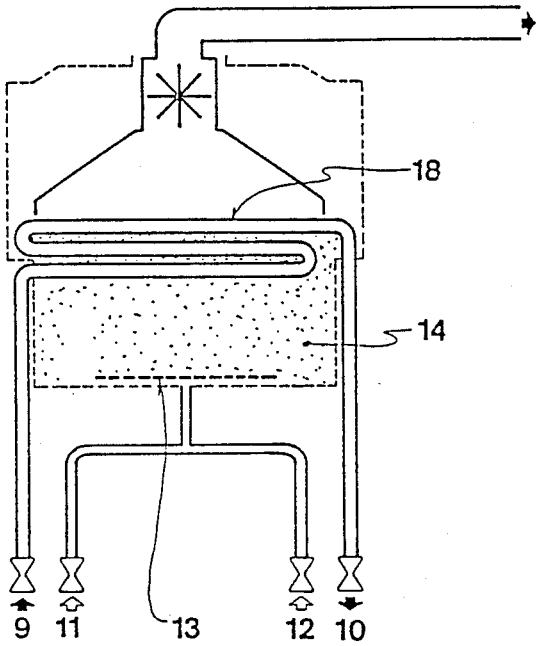
FIG. 2 shows a boiler with a water heating coil embedded horizontally in the catalyst bed.
Figure 4:
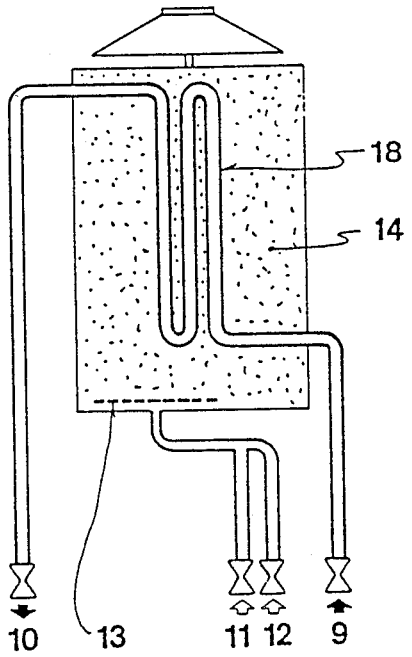
FIG. 4 shows a boiler with a water heating coil positioned vertically in the catalyst bed.

The water for sanitary or heating use is fed through the valve 9 to the coil 18 (in the case of FIGS. 2 and 4)

embedded in the catalyst bed 14, and leaves towards the user through the valve 10.

Figure 6:
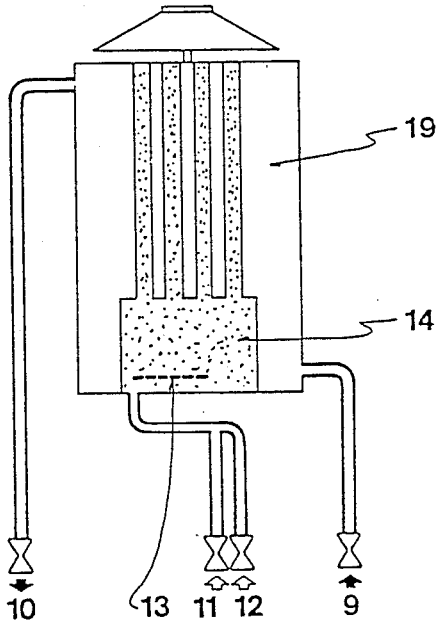
FIG. 6 shows a boiler of the tube bundle type with the catalyst contained in parallel vertical tubes and the water circulating outside them.
Figure 7:
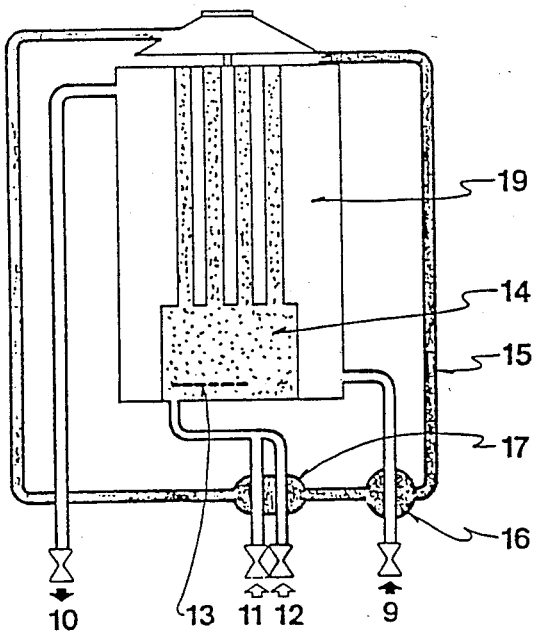
FIG. 7 shows the boiler of FIG. 6 with flue gas recirculation for preheating the feed water and air.

FIGS. 6 and 7 show a boiler in which the catalyst 14 is contained inside the tubes of a tube bundle comprising vertical parallel tubes.

In this case, the water to be heated is fed through the valve 9 to the shell side 19 of the tube bundle, the tubes of which contain the catalyst, and leaves towards the user system through the valve 10.

Figure 3:
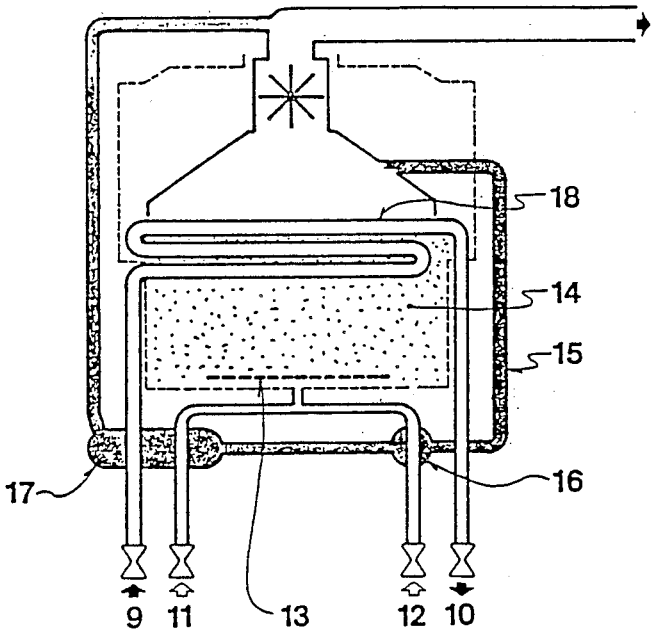
FIG. 3 shows the boiler of FIG. 2 with five gas recirculation for preheating the feed water and oxygen.
Figure 5:
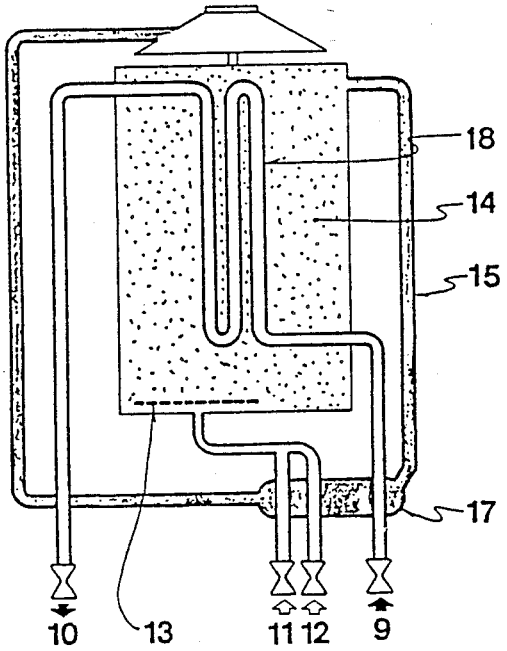
FIG. 5 shows the boiler of FIG. 4 with flue gas recirculation for preheating the feed water and oxygen.

FIGS. 3, 5 and 7 show heat recovery systems for the gaseous combustion products, which are recycled through the pipe 15, to preheat the water, methane and oxygen fed to the boiler through the heat exchanger systems 16 and 17.

What is claimed:

1. A boiler for heating water for domestic use, comprising a catalyst container, a catalyst positioned in said catalyst container, means for introducing methane and oxygen into said container, a combustion triggering means for raising the temperature of said catalyst to a value at which said methane reacts with said oxygen in the presence of said catalyst, thereby initiating combustion of said methane to produce combustion products, heat transfer means for effecting heat transfer between said combustion products and said water, and a control system for controlling a temperature of combustion in said container, said control system comprising at least one thermocouple positioned in said catalyst and connected to a methane gas feed shut-off system, said catalyst consisting of one or more metals of the platinum group supported on a granular solid, the metal content of the catalyst being between 0.01% and 1% by weight of the total.

2. A boiler as claimed in claim 1, characterized in that the catalyst is disposed in one or more layers inside the container, the heat transfer means consisting of one or more tubes through which the water to be heated passes.

3. A boiler as claimed in claim 2, wherein said tubes are finned.

4. A boiler as claimed in claim 2, characterized in that the tubes are disposed vertically parallel to each other inside the catalyst mass.

5. A boiler as claimed in claim 1, characterized in that the catalyst container consists of one or more tubes filled with the catalyst, the water to be heated passing around said tube or tubes.

6. A boiler as claimed in claim 5, wherein said tubes are finned.

7. A boiler as claimed in claim 1, characterized in that the methane gas is premixed with air and with part of the cooled gaseous combustion products, the mixture being made to pass through the catalyst at a spatial velocity of between 5,000 and 100,000 volumes of mixture/volume of catalyst per hour.

8. A boiler as claimed in claim 7, characterized in that the air/methane mixture which passes through the catalyst has an oxygen content which ranges from stoichiometric to a volumetric excess of 20% over that necessary for complete combustion of the methane.

9. A boiler as claimed in claim 1, characterized in that the combustion reaction between the methane and the oxygen is triggered by an electrical resistance heater positioned in the catalyst in the vicinity of an inlet or inlets for said methane and said oxygen.

10. A catalyst for the combustion of methane with oxygen for use in the boiler claimed in claim 1, characterized in that the solid support is alumina.

11. A catalyst as claimed in claim 10, characterized in that the alumina is in the form of spheres having a diameter of between 0.1 mm and 30 mm.

12. A boiler as claimed in claim 1, characterized in that the catalyst is disposed in the container in one or more layers alternating with layers of solid material in divided form or mixed with said solid material.

13. A boiler as claimed in claim 12, characterized in that the solid material in divided form is the same as that used as the catalyst support.

14. A boiler as claimed in claim 12, characterized in that the volumetric ratio of catalyst to solid material in divided form is between 1:1 and 1:100.

* * * * *